US005752620A

United States Patent [19]

Pearson

[11] Patent Number: 5,752,620

[45] Date of Patent: May 19, 1998

[54] MEDICATION DISPENSER

[75] Inventor: Walter G. Pearson, Pineville, La.

[73] Assignee: Pearson Ventures, L.L.C., Pineville, La.

[21] Appl. No.: 747,632

[22] Filed: Nov. 13, 1996

[51] Int. Cl.[6] ..... B65D 83/04

[52] U.S. Cl. ..... 221/2; 221/133; 221/152; 221/185; 221/190; 221/191; 221/254; 221/278

[58] Field of Search ..... 221/2, 7, 8, 124, 221/133, 151, 152, 153, 185, 190, 191, 192, 254, 258, 278, 266

[56] References Cited

U.S. PATENT DOCUMENTS

| | | | |
|---|---|---|---|
| 541,039 | 6/1895 | Courtois | 221/190 |
| 922,472 | 5/1909 | Gleasure | 221/190 |
| 939,100 | 11/1909 | Schille | 221/192 |
| 1,486,690 | 3/1924 | Scheliga | 221/190 |
| 2,507,186 | 5/1950 | Schneider | 221/254 |
| 3,662,920 | 5/1972 | Lubin | 221/254 |
| 4,573,606 | 3/1986 | Lewis et al. | 221/2 |
| 5,099,463 | 3/1992 | Lloyd et al. | 221/2 |
| 5,667,096 | 9/1997 | Wu | 221/133 |

*Primary Examiner*—H. Grant Skaggs

*Attorney, Agent, or Firm*—Warner J. Delaune; John H. Runnels

[57] ABSTRACT

A pill dispenser is provided, comprising a container constructed to hold a plurality of pills, the container including an upper portion and a lower portion; an inclined baffle disposed within the container separating the upper portion from the lower portion, wherein the baffle has an aperture; a first opening in the lower portion; a pill holder, slidably disposed within the first opening and sized to fit through the aperture, for holding a pill located in the container; and an exit port in the upper portion aligned with the inclined baffle, wherein the exit port is sized to allow the pill to exit the upper portion. A pill release mechanism is provided within the pill holder to dislodge the pill from the pill holder by pneumatic pressure once the pill has risen above the baffle. Sensors are located on the exit port to detect the presence of a dispensed pill, which is recorded by an attached computer. Optionally, a locking device is attached to the pill dispensing units to prevent unauthorized dispensation of medication. A plurality of the pill dispensing units may be placed within a portable cart so that medication can be provided to multiple patients in a variety of health care environments.

12 Claims, 5 Drawing Sheets

MEDICATION DISPENSER

BACKGROUND OF THE INVENTION

I. Field of the Invention

This invention pertains to medication dispensers, particularly to medication dispensers suitable for dispensing multiple medications to multiple patients with minimal risk of error, pilferage, and contact with the medications.

II. Description of the prior Art

Hospitals, clinics, nursing homes, and the like typically must dispense multiple medications to multiple patients on ever-changing schedules. Insuring that the right patient receives the right amount of the right medication at the right time presents significant logistical problems to the personnel responsible for prescribing, dispensing, and administering the medications. Even when everything in the system works properly, the logistics and paperwork required to dispense all medications to a group of patients correctly can be very time-consuming, labor-intensive, and expensive.

Unfortunately, it is not uncommon for medications to be administered to the wrong patient, or to the right patient in the wrong amount or at the wrong time. Such mistakes can arise in many ways. A patient may be misidentified, or moved to a different bed. Busy nurses may neglect to cross-check patient identification numbers in all cases. The cups containing different patients' medications may inadvertently be switched. The potentially harmful consequences of incorrectly dispensing medications to patients requires no elaboration.

Compounding these already-difficult logistical problems is the fact that a clandestine demand exists for many prescription drugs, requiring that appropriate security measures be taken to minimize the risk of theft.

In addition to the foregoing difficulties, it is essential that patients receive their medication without contamination from other sources. This is especially so in the case of patients who have hypersensitive reactions to certain chemicals. The primary sources of contamination are most often from the handling of the medication by the health care provider or the patient. For example, if the attending nurse has handled a previous medication for another patient, trace amounts of that drug may contaminate the medication for the next patient if also touched by the nurse. However, the medication administration systems used by most medical institutions do not ensure that the medication remains untouched before being consumed by the patient.

U.S. Pat. No. 3,848,112 discloses magnetically coded identification tags for correlating the identity of a patient to the patient's prescriptions, samples, and the like.

U.S. Pat. No. 4,695,954 discloses a medication dispensing system for use with a single patient, in which all medications to be dispensed at a particular time for that patient are manually loaded into a particular compartment of the device, and the device allows access to each compartment at the appropriate time.

U.S. Pat. No. 4,971,221 discloses a drug dispenser with a monitor such as an optical sensor to detect when a dose of the drug has been dispensed.

U.S. Pat. No. 4,967,928 discloses a medication cart with an on-board computer system in which unsecured medications are stored in conventional cabinet cubicles; and in which secured narcotics are either stored in a single-dose, automatic dispenser apparatus requiring special packaging for dispensing doses of the narcotics, or are stored in a locked conventional cubical.

U.S. Pat. No. 3,917,045 discloses an automatic drug dispensing apparatus which dispenses drugs from cartridges, each of which holds a plurality of individual drug dosages.

U.S. Pat. No. 4,847,764 discloses a system for dispensing medications in a health care institution in which a central computer system controls a plurality of remote medication dispensers.

Other patents cited during the prosecution of one of my previous patents, U.S. Pat. No. 5,571,258, include the following: U.S. Pat. Nos. 3,986,638 and 4,561,687.

There is a continuing, unfilled need for a multi-patient, multi-medication, semi-automated medication dispenser that can correctly dispense the correct medications to the correct patients at the correct times in the correct dosages, in any sequence of patients that is convenient, in a manner that is cost-efficient, that reduces the amount of human labor required, that minimizes the risk of error, that does not require any special packaging for pills dispensed, that is resistant to pilferage, and that eliminates the need to touch the medication.

A novel, semi-automated medication dispenser has been invented that greatly simplifies the logistics of correctly dispensing multiple medications to multiple patients in the correct dosages at the correct times, in a manner that is cost-efficient and labor-efficient, that greatly reduces the probability of errors, and that inhibits pilferage. The novel dispenser can be loaded with many days' worth of medication (e.g., 30 days) at one time, and requires no special packaging for the medications.

The novel dispenser is controlled by a computer. Patient information and physician orders are entered into the computer's memory. Medications needed by all the patients in a ward are loaded into individual pill dispensing units, for example by a pharmacist. Many days' worth of medication may often be loaded at once.

After the medications are loaded into the pill dispensing units, access to the individual units is controlled by the computer. When a proper password is entered—for example by the dispensing nurse—followed by identifying information for a particular patient, the computer allows operation of only those units containing medications that are appropriate for the individual patient at that time. The computer and the design of each unit control the dosage of the medication being dispensed as well. For example, the pill holding portion of the unit can only hold a single pill, and the computer tracks the precise number of pills dispensed by the sensors on each unit. Thus, each patient receives all appropriate medications, and only the appropriate medications. The computer also simultaneously makes a record of the medications administered to each patient. In the entire process, human hands need never touch the tablets or capsules being dispensed to the patient.

DESCRIPTION OF THE PREFERRED EMBODIMENTS

Figure 1:
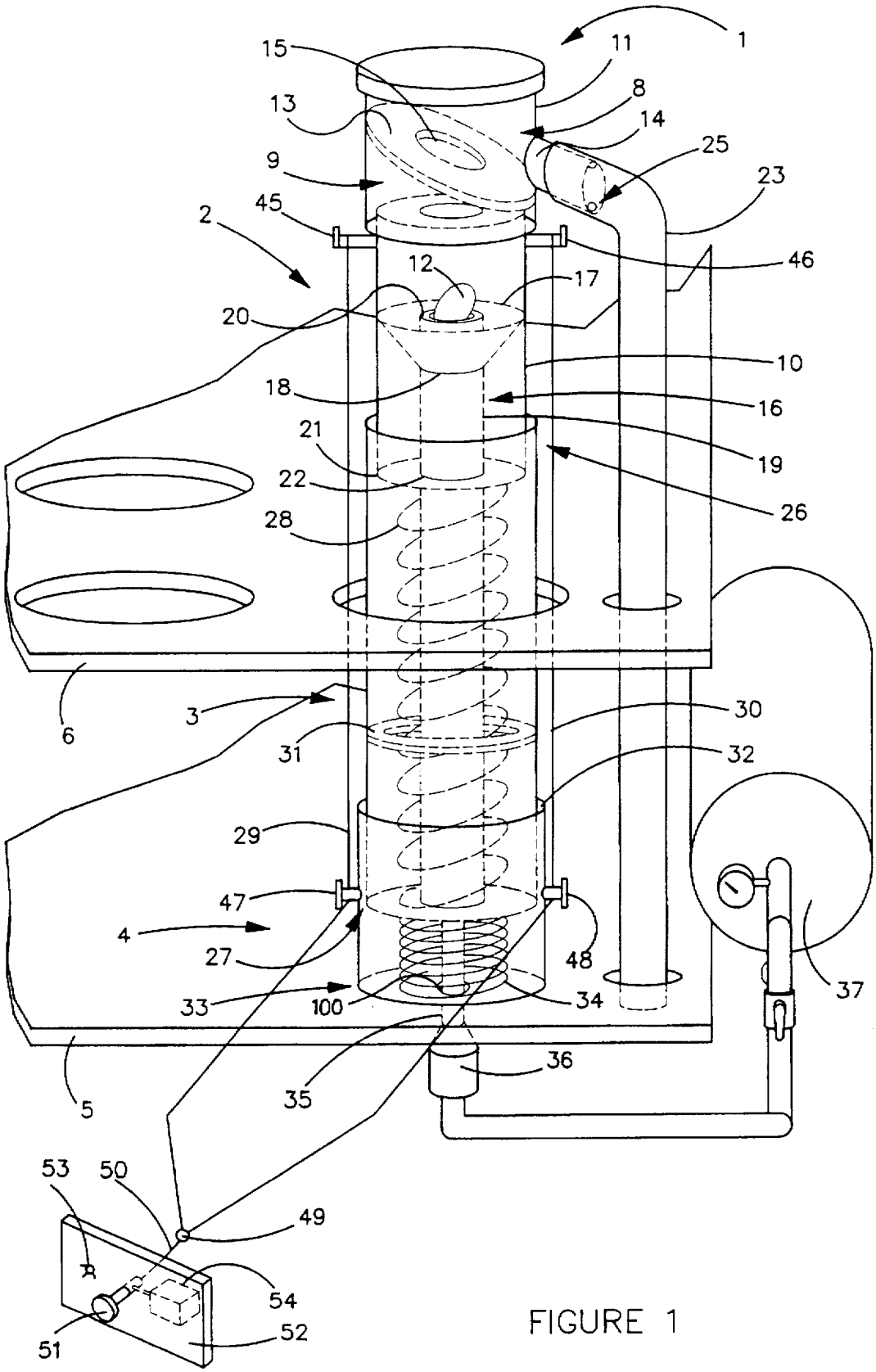
FIG. 1 is a perspective view of a preferred embodiment of a single pill dispensing unit positioned within the framework of a portable cart.

Turning now to FIG. 1, a perspective view of one embodiment of the pill dispensing unit 1 is shown to generally comprise an upper pill module 2, a middle guide cylinder 3, and a base 4. As will be explained further herein, pill module 2 is slidably disposed within guide cylinder 3, and guide cylinder 3 is slidably disposed within base 4. Primary and secondary support platforms 5,6 are present within a portable cart 7, shown best in FIG. 5, to support a plurality of pill dispensing units 1. For reasons of clarity, only one pill dispensing unit 1 is depicted in FIG. 1.

Pill module 2 comprises an open holding container 10 and a cover 11. Cover 11 is preferably removable from holding container 10 by conventional fastening means, such as by mating threaded or locking portions, so that pills 12 can be added to holding container 10 as necessary. Cover 11 includes two main regions, an upper portion 8 and a lower portion 9, which are separated by an inclined baffle 13. Baffle 13 may either be fixed to the inside of cover 11, or it may simply rest on a ledge (not shown) which maintains the baffle 13 at an incline. The degree of incline of baffle 13 need only be sufficient to allow any pills 12 to slide downward toward an exit port 14 formed into cover 11. Baffle 13 includes an aperture 15 which is large enough to permit passage therethrough of pill holding means 16. Importantly, aperture 15 must also be small enough to prevent a pill 12 from falling back into holding container 10, or from becoming lodged between pill holding means 16 and baffle 13, once the pill 12 has separated from pill holding means 16, as will be further explained below.

Figure 2:
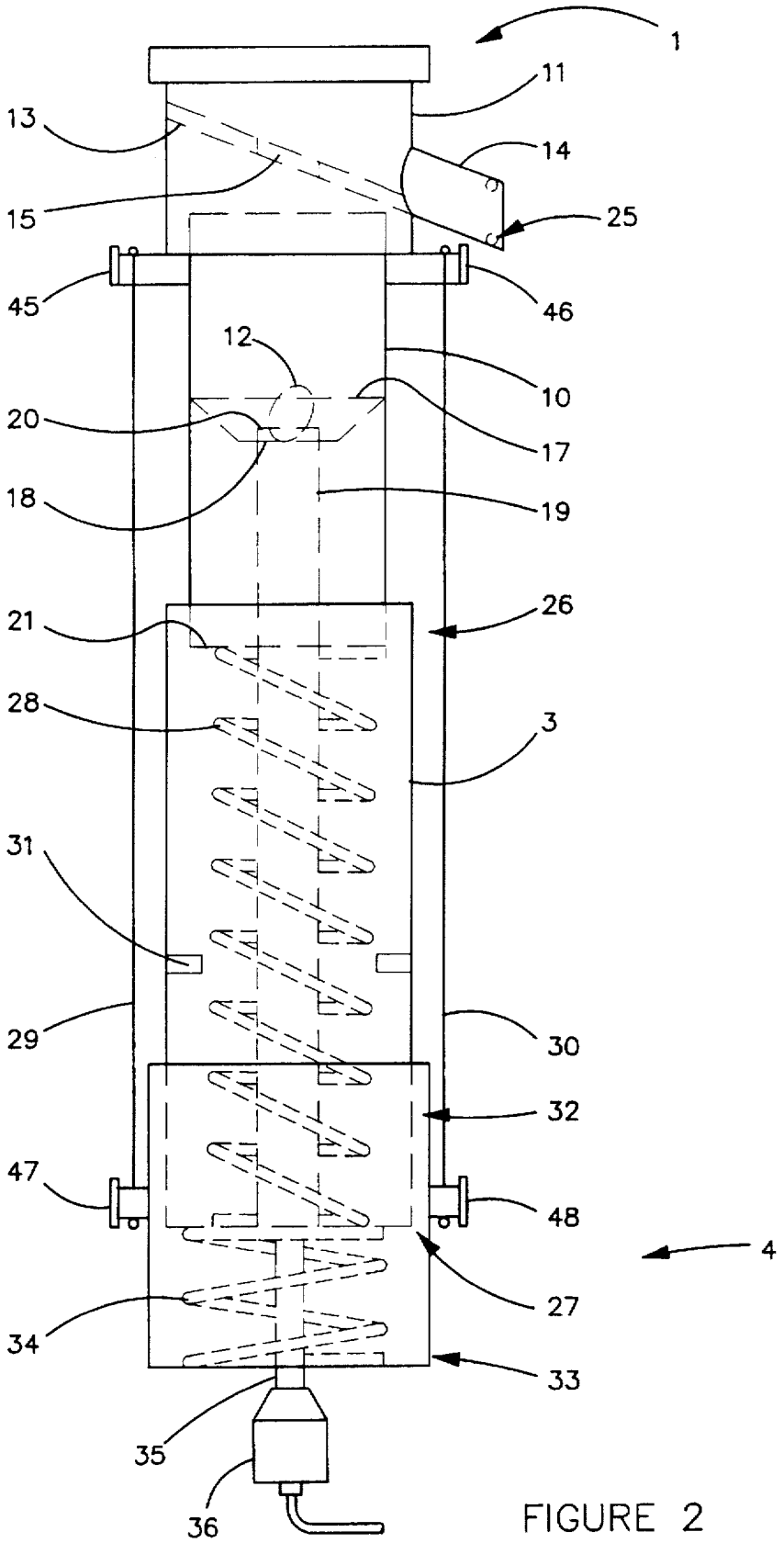
FIG. 2 is a side view of the pill dispensing unit of FIG. 1 in a rest position.

Pills 12 are retained at a predetermined level within holding container 10 by a cone-shaped bowl 17 attached to the inside of holding container 10. Bowl 17 includes a first opening 18 which allows passage therethrough of pill holding means 16. Similar to aperture 15, first opening 18 must be small enough to prevent pills 12 from falling below bowl 17, or from becoming lodged between bowl 17 and pill holding means 16. A preferred embodiment of pill holding means 16 employs a hollow tube 19 which extends from the bottom portion 27 of guide cylinder 3 and which always resides within first opening 18. Importantly, in a rest position, the top surface 20 of tube 19 is immediately adjacent to first opening 18 so that pills 12 within holding container 10 may roll or tumble freely onto tube 19, guided by the cone-shaped surface of bowl 17. This precise positioning is best illustrated in FIG. 2, and it ensures that all of the pills 12 within holding container 10 can be dispensed before refilling is required, thus helping to maintain uniformity of expiration dates of medication. Holding container 10 also includes a bottom 21 having a second opening 22 identical in size and shape to first opening 18. In this manner, tube 19 may freely slide within holding container 10.

Figure 3:
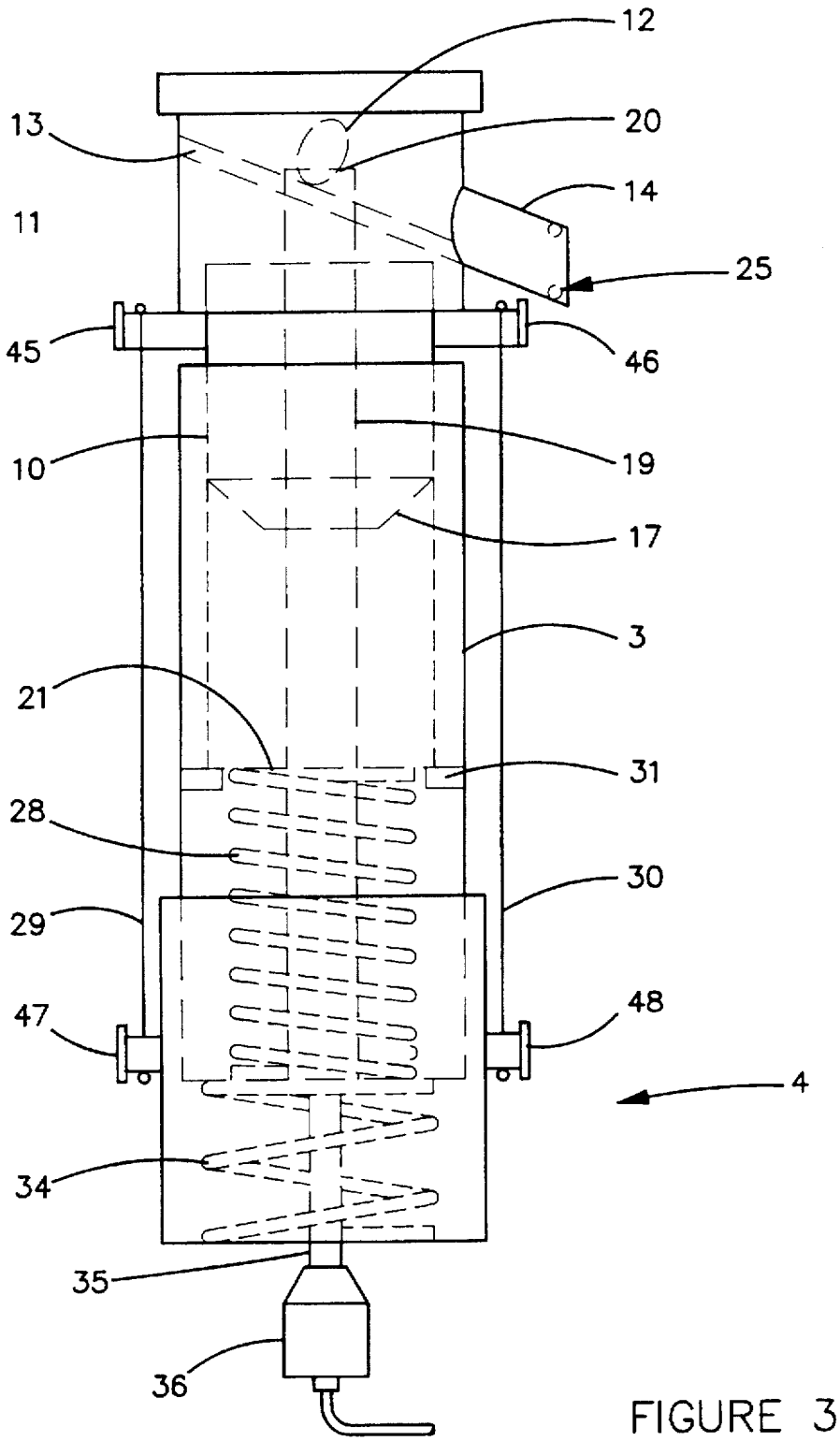
FIG. 3 is a side view of the pill dispensing unit of FIG. 1 in maximum displacement.

Exit tube 23 is sealably fastened to exit port 14 to guide each pill 12 to an inclined pill collection tray 24 located below all of the pill dispensing units 1. An infrared sensor 25, having an emitter and a detector, is located within exit port 14 to sense the passage of a pill 12 through exit port 14, as shown in FIGS. 2 and 3. The passage of a pill 12 interrupts the detection of infrared energy from the emitter, and an audible or visual signal is generated by a connected computer 60, along with other effects to be explained further herein.

Guide cylinder 3 includes an open top portion 26 and a closed bottom portion 27, and is sized to allow holding container 10 to slide freely therein. Main spring 28 is a compression spring which is positioned within guide cylinder 3, simultaneously contacting both the bottom portion 27 of guide cylinder 3 and the bottom 21 of holding container 10. In a rest position of pill dispensing unit 1, main spring 28 is in a compressed state so as to provide an upward biasing force against holding container 10. As will be further explained below, holding container 10 is prevented from leaving guide cylinder 3 by guide wires 29,30 used to operate the unit 1. An annular ledge 31 is fixed within guide cylinder 3 to contact the bottom 21 of holding container 10, thus stopping the travel of holding container 10 relative to guide cylinder 3. The precise location of annular ledge 31 is determined by the dimensions of the other components of the unit 1, but it should allow enough travel of holding container 10 to permit the pill 12 to enter the upper portion 8 of cover 11. The outside diameter of main spring 28 is such that no interference will exist between annular ledge 31 and main spring 28 during operation.

Base 4 includes an open top portion 32 and a closed bottom portion 33, and is sized to allow guide cylinder 3 to slide freely therein. Secondary spring 34 is a compression spring which is positioned within guide cylinder 3, simultaneously contacting both the bottom portion 33 of the base 4 and the bottom portion 27 of the guide cylinder 3. Secondary spring 34 has a spring constant which is greater than that of the main spring 28 to such an extent that compression of main spring 28 will not compress secondary spring 34 until after holding container 10 begins to push on annular ledge 31.

As explained previously, pill holding means 16, in the form of tube 19, is attached to the bottom portion 27 of guide cylinder 3. Tube 19 is hollow and is in fluidic communication with a valve actuation member 35, a hollow cylinder, extending from the bottom portion 27 of guide cylinder 3. Valve actuation member 35 further extends past the bottom portion 33 of base 4 through an opening 100 toward a valve 36 connected to a pressurized gas source 37. Valve 36 is capable of receiving the terminal end of valve actuation member 35 such that when the unit 1 is operated, valve actuation member 35 enters valve 36 and causes a sudden release of pressurized gas, such as air, from gas source 37. This type of operation of valve 36 is quite similar to the operation of common air valves used with inner tubes, such as on vehicle tires. The simplicity of operation of valve 36 therefore allows a great diversity of valves to be employed with substantially equal effectiveness. Because of the fluidic connection between valve actuation member 35 and tube 19, the burst of air continues upward within tube 19 to actuate a plunger 38 as explained below.

Figure 4B:
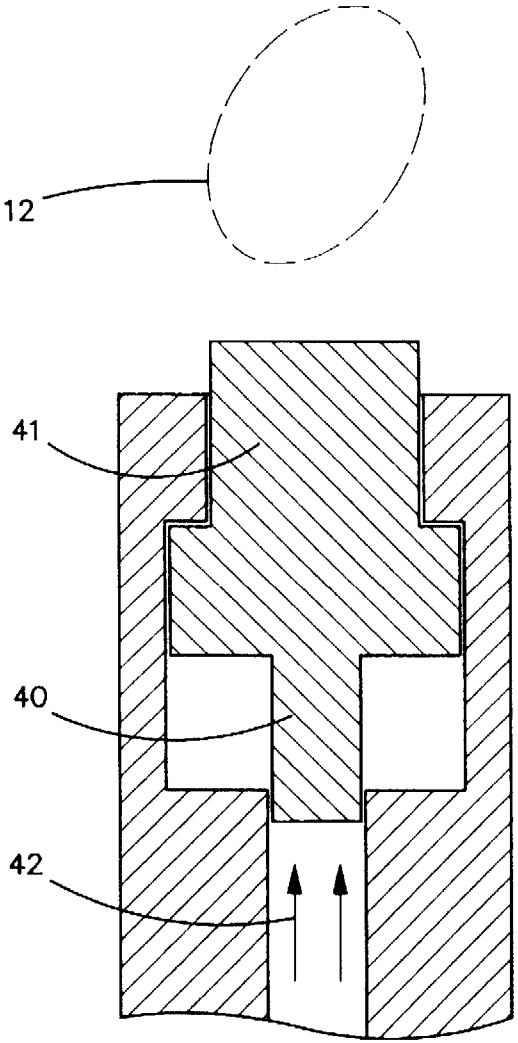
FIG. 4A and 4B depict the plunger feature of the invention before and after activation.
Figure 4A:
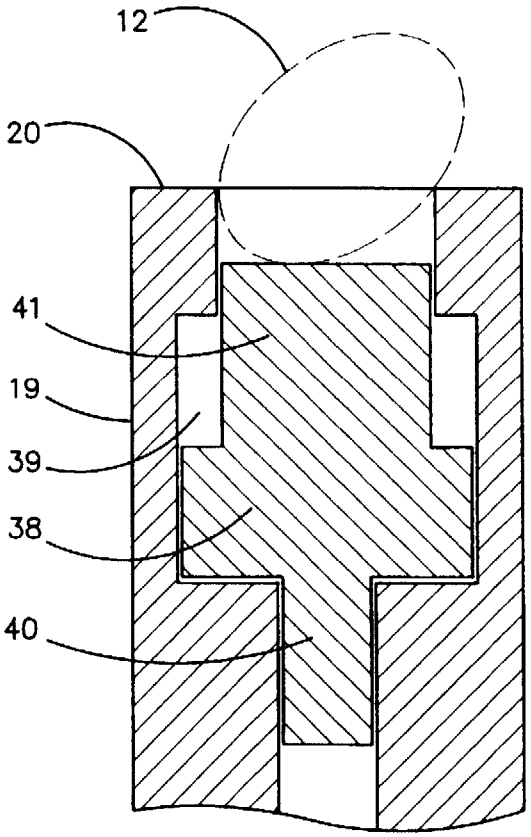

FIGS. 4A and 4B illustrate the details of the plunger 38 used to separate the pill 12 from the top of tube 19. Plunger 38 is retained within a cavity 39 formed within tube 19 and is restricted to vertical motion. A downwardly extending member 40 of plunger 38 is slidable within a reduced diameter of the tube 19, while an upwardly extending member 41 is slidable within the top of tube 19 immediately below a pill 12. As shown in FIG. 4A, pill 12 actually rests partially on top of the upwardly extending member 41. As air is released from valve 36, the pressurized air 42 causes plunger 38 to travel upward in a sudden and forceful manner until it reaches its limiting position. The action of the plunger 38 knocks the pill 12 from the top of tube 19, causing it to fall onto the baffle 13 below. Because of the cylindrical shape of cover 11, pill 12 is guided by gravity to exit port 14.

Operation of the pill dispensing unit 1 can be accomplished by a wide variety of methods, only one of which is depicted in FIGS. 1–3. In the embodiment shown, holding container 10 includes a pair of loops or hangers 45,46 which permit attachment of guide wires 29,30, respectively. Guide wires 29,30 extend downward and are looped partially around studs 47,48 which are attached to base 4, as shown in FIG. 1. Guide wires 29,30 are joined together at point 49 to form a single wire 50 which is connected to a manually manipulatable device, such as a pull handle 51. Handle 51 extends from a panel 52 on the portable cart 7. Indicating means 53, such as a flashing light, is present next to handle 51 and is activated by computing means 60 to indicate to the operator which handle 51 to pull on the cart 7. Thus, when handle 51 is pulled, the guide wires 29,30 cause the holding container 10 to slide downward within guide cylinder 3. If one continues to pull on handle 51, the valve 36 will be actuated when the unit 1 is at its maximum displacement (shown in FIG. 3), and a pill 12 will be released. Releasing the handle 51 will allow the unit 1 to return to the rest position depicted in FIG. 1 and 2. Alternatively, the studs 47,48 may be placed on some other rigid structure, such as platform 5, as long as guide wires 29,30 can pull vertically on holding container 10. In either case, it is imperative that the unit 1 be firmly and stably mounted on the platform 5. If desired, a series of pulleys and/or gears can also be employed to reduce the distance that handle 51 must be pulled to create a full cycle of motion for the unit 1.

Preferably, locking means 54, such as a solenoid-activated pin, is connected to some part of the unit 1 to prevent unauthorized dispensing of pills 12. For example, such a pin can be positioned behind each panel 52 so as to enter a hole (not shown) in each handle 51 so that one cannot pull the handle 51 until the solenoid is deactivated by the computer 60. Alternatively, such a pin can be positioned on platforms 5 or 6 so that the pin enters holes (not shown) through the guide cylinder 3 or the base 4 to prevent actuation of the valve 36 or lowering of the baffle 13.

Another method of operating the units 1 would not employ guide wires 29,30, but would involve simply pushing downward on cover 11 until the valve 36 is actuated. An alternative indicating means 53 could be located on top of cover 11 to clearly inform the operator of the correct unit 1 to push. In this method, locking means 54 would be used directly with the guide cylinder 3 or the base 4. It will also be appreciated that each unit 1 can be automated by motor-driven means (not shown) which would be activated by the press of a button on panel 52. If motor-driven means were employed, locking means 54 may be as simple as a switch or relay which would deliver electricity to the motor only when enabled by computing means 60.

Figure 5:
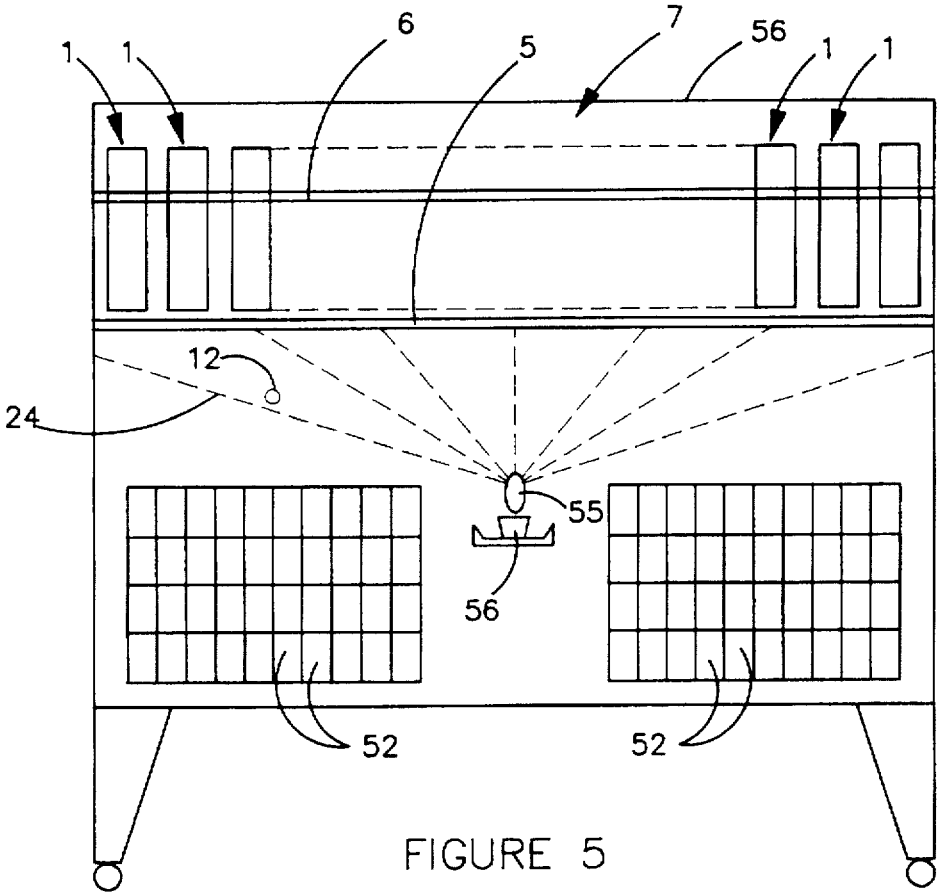
FIG. 5 is a front view of one embodiment of a portable cart which could accommodate many of the pill dispensing units.
Figure 6:
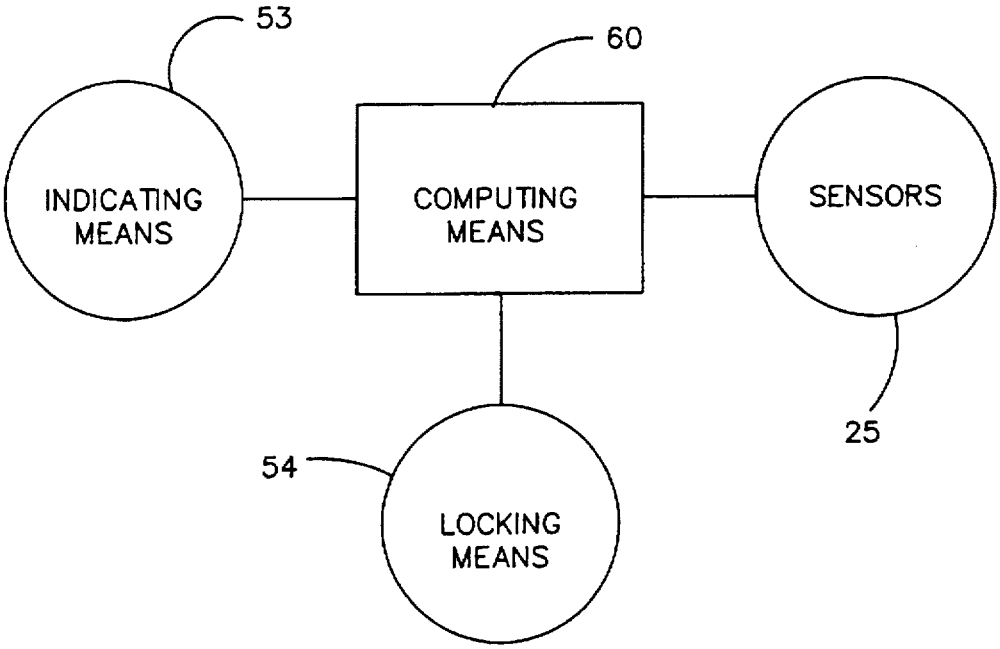
FIG. 6 is a schematic diagram of the electrical connections in the present invention.

As shown in FIG. 5, a portable cart 7 can be used to support a plurality of pill dispensing units 1. As mentioned earlier, an inclined pill collection tray 24 is contained within cart 7 so that any pills 12 dispensed from any unit 1 are collected at a single common location 55. Once the pill 12 reaches the common location, it may be caught in a souffle cup 56 typically used to administer medication in health care environments. Optionally, a lockable protective cover 56 can also be used to cover the units 1 to prevent unauthorized or inadvertent operation of the units 1.

Finally, a summary of the steps of pill dispensation is provided. Cover 11 is removed from holding container 10 to fill the holding container 10 with the desired pills 12. When the particular patient is reached by the nurse, the nurse calls up the patient information on computing means 60 to prepare the appropriate unit 1 for dispensing the necessary medication. Each unit 1 is assigned a unique address which is maintained and regularly updated on computing means 60. When the nurse informs computing means 60 that she is ready to receive the medication, computing means 60 sends a signal to both indicating means 53 and locking means 54. Indicating means 53 begins to flash or provide some visual signal to the nurse of which unit 1 is to be operated, and locking means 54 is caused to unlock the unit 1 (or provide operating power) for operation. The nurse then operates the unit 1 by pulling the appropriate handle 51, pressing the appropriate button, or otherwise causing the unit 1 to function. Given the capabilities of modern control systems, the appropriate unit 1 can even be operated entirely from a signal sent by computing means 60 when it is time to administer the medication.

Regardless of how the unit 1 is displaced from its rest position, the pill module 2 comprised of cover 11 and holding container 10 is drawn downward against the force of main spring 28. As the holding container 10 descends, the top surface 20 of tube 19 moves away from first opening 18 in bowl 17. As the tube 19 begins to leave the volume of pills 12 in holding container 10, a single pill 12 is retained at the top of tube 19. Holding container 10 and cover 11 continue to descend until the top surface 20 of tube 19, with its retained pill 12, is immediately above aperture 15 in baffle 13. At this point, the bottom 21 of holding container 10 contacts the annular ledge 31 within guide cylinder 3, which initiates the downward movement of guide cylinder 3 through base 4 against the force of secondary spring 34. Valve actuation member 35, which is attached to the bottom portion 27 of guide cylinder 3, proceeds downward until it pushes the releasing mechanism of the valve 36. Upon actuation of valve 36, the pressurized air from gas source 37 travels through the hollow valve actuation member 35 and through hollow tube 19. Almost immediately, plunger 38 is pushed upward to dislodge the pill 12 resting on tube 19, causing the pill 12 to roll down the inclined baffle 13 until it passes through exit port 14. Sensors 25 detect the presence of the pill 12 just before pill 12 travels down exit tube 23, triggering an audible or visual signal emitted by computing means 60 and registering the dispensation of a single pill 12 for that patient. Because computing means 60 controls the precise number of pills dispensed, the correct dosage can be ensured, and an accurate inventory of medication can be maintained. The release of the pressurized gas is very brief, because the unit 1 begins its return to the rest position immediately after actuation of the valve 36, thus pulling valve actuation member 35 away from valve 36 and allowing valve 36 to close until the next operation cycle.

Pill 12 travels down exit tube 23 until it falls into the common pill collection tray 24. The incline of pill collection tray 24 causes pill 12 to reach a souffle cup 56 at common location 55, after which the nurse retrieves the medication and delivers it to the current patient. As an alternative to the common pill collection tray 24, it is within the scope of this invention to either extend each exit tube 23 to the common location 55, or to provide individual trays or troughs to reach common location 55. Such an arrangement may serve to minimize any potential cross-contamination between medications, thus addressing the concerns of those patients who might experience hypersensitivity to certain medications.

As the holding container 10 and cover 11 return to their original rest position shown in FIGS. 1 and 2, holding container 10 ascends along tube 19 until the top surface 20 of tube 19 becomes submerged within the volume of pills 12 within holding container 10. The unit 1 then comes to rest precisely when the top surface 20 of tube 19 is vertically aligned within the first opening 18 in bowl 17. At this point, locking means 54 re-engages to prevent unauthorized operation of the unit 1, and indicating means 53 is deactivated.

I claim:

1. A pill dispenser, comprising:

(a) a container constructed to hold a plurality of pills, said container including an upper portion and a lower portion;

(b) an inclined baffle disposed within said container separating said upper portion from said lower portion, said baffle having an aperture;

(c) a first opening in said lower portion;

(d) pill holding means, slidably disposed within said first opening and sized to fit through said aperture, for holding a pill located in said container; and (e) an exit port in said upper portion aligned with said inclined baffle, wherein said exit port is sized to allow said pill to exit said upper portion.

2. The pill dispenser according to claim 1, wherein said aperture in said baffle is small enough to prevent said pill from re-entering said lower portion after said pill has entered said upper portion and has been released from said pill holding means.

3. The pill dispenser according to claim 1, wherein said first opening is sufficiently small to prevent said pill from leaving said lower portion when said pill holding means is present within said first opening.

4. The pill dispenser according to claim 1, further comprising an exit tube attached to said exit port, said exit port having sensing means for detecting the passage of said pill therethrough.

5. The pill dispenser according to claim 1, further comprising pill releasing means operatively connected to said pill holding means, for causing the release of said pill from said pill holding means after said pill holding means has entered said upper portion of said container.

6. The pill dispenser according to claim 5, wherein said pill holding means comprises a hollow tube having an upper end shaped to hold said pill; and wherein said pill releasing means comprises:

(a) a plunger slidably disposed and retained within said tube; and (b) plunger activating means pneumatically connected to said plunger for delivering a pneumatic force through said tube sufficient to displace said plunger and forcibly separate said pill from said upper end of said tube.

7. The pill dispenser according to claim 6, wherein said plunger activating means comprises a valve connected to a pressurized gas source, and wherein said valve is actuated by a valve actuation member operatively connected to said tube.

8. A pill dispensing system, comprising a portable cart having an array of two or more pill dispensing units, each said unit comprising:

(a) a container constructed to hold a plurality of pills, said container including an upper portion and a lower portion;

(b) an inclined baffle disposed within said container separating said upper portion from said lower portion, said baffle having an aperture;

(c) a first opening in said lower portion;

(d) pill holding means, slidably disposed within said first opening and sized to fit through said aperture, for holding a pill located in said container; and (e) an exit port in said upper portion aligned with said inclined baffle, wherein said exit port is sized to allow said pill to exit said upper portion.

9. The pill dispensing system of claim 8, further comprising pill collection means located below said array for receiving said pill from said exit port and delivering said pill to a predetermined location.

10. The pill dispensing system of claim 8, wherein each of said pill dispensing units includes a flexible member having a first end and a second end, wherein said first end is operatively connected to said pill container and wherein said second end is operatively connected to a manually manipulatable device on said cart.

11. The pill dispensing system of claim 8, further comprising:

(a) indicating means positioned adjacent to each of said pill dispensing units for identifying, when activated, the particular pill dispensing unit to be used for a particular patient; and (b) computing means operatively connected to said indicating means for cataloging patient information, medication, dosage, and other selected parameters and for activating said indicating means for an appropriate pill dispensing unit.

12. The pill dispensing means of claim 11, further comprising:

(a) sensing means operatively connected to said exit port of each of said pill dispensing units and to said computing means for detecting the passage of said pill through said exit port and reporting said passage to said computing means; and (b) locking means operatively connected to each of said pill dispensing units and to said computing means for preventing unauthorized operation of said pill dispensing units. Wherein said locking means is disengaged by said computing means concurrently with the activation of said indicating means, and wherein said locking means is re-engaged after detection of said pill by said sensing means.

* * * * *